US006853895B2

(12) United States Patent
Javaherian

(10) Patent No.: US 6,853,895 B2
(45) Date of Patent: Feb. 8, 2005

(54) METHOD FOR REMOTE ENGINE START

(75) Inventor: Hossein Javaherian, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 61 days.

(21) Appl. No.: 10/313,613

(22) Filed: Dec. 6, 2002

(65) Prior Publication Data

US 2004/0111199 A1 Jun. 10, 2004

(51) Int. Cl.[7] ..... F02D 41/00; F02N 17/00; F02N 11/08

(52) U.S. Cl. ..... 701/36; 701/100; 123/491

(58) Field of Search ..... 701/36, 100; 123/655, 123/179.1, 179.21, 179.3, 179.2, 179.4, 179.16, 491, 488; 290/38 C, 38 E

(56) References Cited

U.S. PATENT DOCUMENTS 4,184,460 A * 1/1980 Harada et al. ..... 123/491
4,232,289 A * 11/1980 Daniel ..... 307/10.4
4,354,554 A * 10/1982 Calhoun et al. ..... 166/321
4,606,307 A * 8/1986 Cook ..... 123/179.2
4,637,359 A * 1/1987 Cook ..... 123/179.3
6,360,726 B1 3/2002 Javaherian ..... 123/491
6,481,428 B1 * 11/2002 Makki et al. ..... 123/685

* cited by examiner

*Primary Examiner*—Tan Q. Nguyen
*Assistant Examiner*—Dalena Tran
(74) *Attorney, Agent, or Firm*—Kathryn A. Marra

(57) ABSTRACT

A method for remote start of a vehicle engine is disclosed. Immediately upon engine start the volatility characteristics of the fuel are determined and this information used to adjust the quantity of fuel injected into the cylinders of the engine during open-loop fuel injection control. Passenger compartment electrical loads are turned off until the catalytic exhaust system is heated to permit closed-loop fuel control. Thereafter, pending operator intervention, the fan, A/C, defroster, and the like, are sequentially turned on and operated for a limited time to prepare the passenger compartment for the absent driver. The method results in minimum emissions, and reduces fuel consumption during extended idle operation while maintaining smooth engine start operation.

16 Claims, 5 Drawing Sheets

METHOD FOR REMOTE ENGINE START

TECHNICAL FIELD

This invention pertains to the management of engine cold start and passenger compartment climate preparation when the driver does not immediately drive the vehicle. The invention is especially useful following engine ignition by means of an electrical signal from a source outside the vehicle. More specifically, this invention pertains to a method for up-integration of remote engine start strategy with the powertrain control module to minimize exhaust gas emissions while providing a comfortable passenger compartment environment.

BACKGROUND OF THE INVENTION

In most automotive vehicle engine starting situations the operator enters the vehicle, starts the engine and drives away. The vehicle contains an under hood, programmed powertrain control module (PCM) that manages fuel injection and transmission shifts in response to the driver set throttle position. The preprogrammed PCM operates to assure smooth engine start, to maximize fuel economy and minimize exhaust emissions during this sudden engine start-up and immediate vehicle operation. Initially, the PCM controls fuel injection in an open loop control regime while the underfloor catalytic exhaust converter and exhaust oxygen sensors are heated by engine exhaust to their effective operating temperatures. Following activation of the catalytic converter and exhaust oxygen sensors, the PCM controls fuel injection in a closed loop mode using oxygen content signals from the oxygen sensor. At the same time the passenger compartment is being heated or cooled, in response to mechanical or electronic inputs from the operator or passengers.

Opportunities now exist for remote starting by the operator. The operator could always manually start the engine and leave the vehicle until the interior was heated (or cooled) to a comfortable temperature or the operator was otherwise ready to leave. But now the operator has the possibility of using a remote electronic key to start the engine just as a remote key can be used to unlock vehicle doors. Also, operators have access to earth satellite based communication services, such as OnStar™ that can be programmed and/or ordered to start the engine at a specified time and for a specific duration. In remote engine start situations, the vehicle operator often expects to have the passenger compartment at a comfortable temperature when he/she chooses to enter the vehicle.

Merely starting the vehicle engine with a remote signal as an add-on is already available in the after-market. But there is a need for a method of managing engine and exhaust system warm up and passenger compartment climate control during remote engine start, when the passenger compartment is unoccupied, to maintain fuel economy and reduce exhaust emissions. It is an object of this invention to provide such a method.

SUMMARY OF THE INVENTION

In accordance with the invention, an electronic microprocessor is programmed to recognize a remote engine start signal or other absent driver start-up situation. Following engine start, the process of this invention manages engine operation and passenger compartment electrical loads while the driver is absent. Preferably the process is executed by, or in combination with the vehicle's engine control module (ECM) or powertrain (i.e., engine plus transmission) control module (PCM).

In accordance with the process of this invention certain baseline conditions are established by the micro-controller. It is first determined whether a bona-fide remote command has been received and whether the key is in the ignition, and even whether the transmission has been engaged. After confirming and entering a remote start process cycle, and immediately following engine ignition, it is preferred that the processor temporarily shut down all electrical load devices pertaining to passenger compartment environment. This temporarily reduces the load on the engine.

The controller then assigns certain time periods that are used in the performance of this start-up process. The controller cannot assume that the operator will actually enter the vehicle in a specific time. For example, a limiting time period should be established within which warm-up is completed and the vehicle is driven away by the operator, or the engine is shut off to conserve fuel. Such a time period, for example ten minutes, may be characterized as the total engine idle time in the context of this process. This idle time is the total time from engine start to either drive the vehicle away or shut-off the engine. A second time period to be set is the estimated time until closed loop engine fuel injection control can be initiated. Additional time periods to be set, for example, are those in which the passenger compartment electrical loads are sequentially turned on, operated and then sequentially shut down if operator activity has not intervened. Such time periods may be suitably predetermined by the manufacturer and stored in the computer memory, or they may be based on ambient conditions such as coolant temperature and air temperature, which are routinely measured by engine sensors. The coolant temperature is preferably used to estimate the time before the catalytic converter is heated by the exhaust gases to its light-off temperature, a temperature at which the catalyst is operating at fifty percent efficiency. These time determinations are all made within a few milliseconds of engine starting.

In most current engines, the PCM is pre-programmed to deliver excess fuel to the cylinders of the engine to assure reasonably smooth engine operation for driver satisfaction. Such a fuel-rich engine start up is often necessary because the PCM does not know the actual volatility of the gasoline and fuel injection timing must be based on the assumption that the fuel has low volatility. It is preferred to estimate the actual volatility, or drivability index, DI, of the fuel in the engine start practice of this invention. A suitable process for detection of fuel volatility is disclosed in U.S. Pat. No. 6,360,726 entitled "Fuel Volatility Detection and Compensation during Cold Engine Start," in the name of the inventor herein, Hossein Javaherian, and assigned to the assignee of this invention.

The '726 patent describes a fuel volatility detection process which is performed during the first second or so following engine ignition. This patent also describes the several engine and exhaust sensors which are typically used for control of fuel injection (and other operating parameters) in a modern gasoline fuelled, multi-cylinder internal combustion engine. This fuel volatility detection process is based on the amount of engine speed droop immediately following engine start when the engine is in the idle-neutral operation mode. The difference in engine speed is correlated with volatility properties of fuels. Accordingly, the disclosure of U.S. Pat. No. 6,360,726 is incorporated in this disclosure by reference. The detection of the drivability index of its fuel is useful in the start up of any cold engine and is preferred for use as part of the subject method. It permits the air to fuel ratio to be successfully leaned without any adverse effects on engine operation. Preferably, the actual fuel volatility is determined early in the execution of this process and an estimated fuel injection cycle is determined for fuel-lean engine operation, and used in the open loop control portion of this start-up process.

The PCM tracks engine run time, now about one second or so. Based on coolant and intake air temperature data provided by suitable sensors, the PCM estimates the time required for activation of the exhaust catalyst (i.e., catalyst light-off time). The PCM microprocessor is now cycling at, for example, 12.5 ms intervals to manage fuel injection and await catalyst light-off and the opportunity for closed-loop engine control. In closed-loop engine control operation, fuel injection is based on signals from an exhaust gas sensor rater than the DI estimate used in open loop engine control. As soon as the catalyst has reached the light-off temperature and the PCM can rely on exhaust sensor input for control of fuel injector timing in closed-loop operation, usually within 20–30 seconds after engine start, it will commence starting passenger compartment electrical loads. Preferably, when the engine is in closed loop operating mode, the PCM can then start the task of bringing the passenger compartment to a temperature specified by the absent, or awaiting, operator The PCM now issues commands for the sequential starting of the air conditioner (in cooling season), the blower, the defroster and defogger and, finally, the instrument panel lights. Preferably, the temperature of the passenger compartment is first changed toward the specified level and then the windows are cleared if clearing is required. Finally the interior lights are turned on in anticipation of the arrival of the driver. The process of bringing the electrical loads into operation may suitably continue over two to three minutes or so. As soon as the driver enters the vehicle and engages the transmission to drive away, the subject start-up process is ended and normal vehicle operation proceeds. However, if the operator does not arrive within a few minutes of engine starting, this process reacts to conserve fuel.

The PCM sets a maximum time for the adjustment of passenger compartment temperature without driver occupancy. After a few minutes of full electrical load operation without driver activity, the PCM then commences issuing commands to sequentially shut down passenger compartment electrical load devices. Preferably, the lights, etc. are shut off in the reverse order of their activation. Finally, if the driver fails to commence vehicle operation within the predetermined electrical device shut-down period, the engine is shut off and the remote start process ended.

At any time during this process, intervention of a driver to engage the transmission and move the vehicle will terminate this remote start process and return the vehicle to normal PCM control.

Thus, the subject process provides a useful process for managing engine operation and control of the passenger compartment environment in the absence of a driver to conserve fuel and minimize exhaust emissions. The process may be used whether the engine is started upon receipt by a vehicle sensor of a remote electronic signal or by the operator using the ignition key and leaving the vehicle during a startup period. Other objects and advantages of the invention will become apparent from a detailed description which follows.

BRIEF DESCRIPTION OF THE DRAWINGS

FIGS. 1A–1D are flow diagrams of a method for the practice of this invention.

DESCRIPTION OF A PREFERRED EMBODIMENT

Figure 1A:
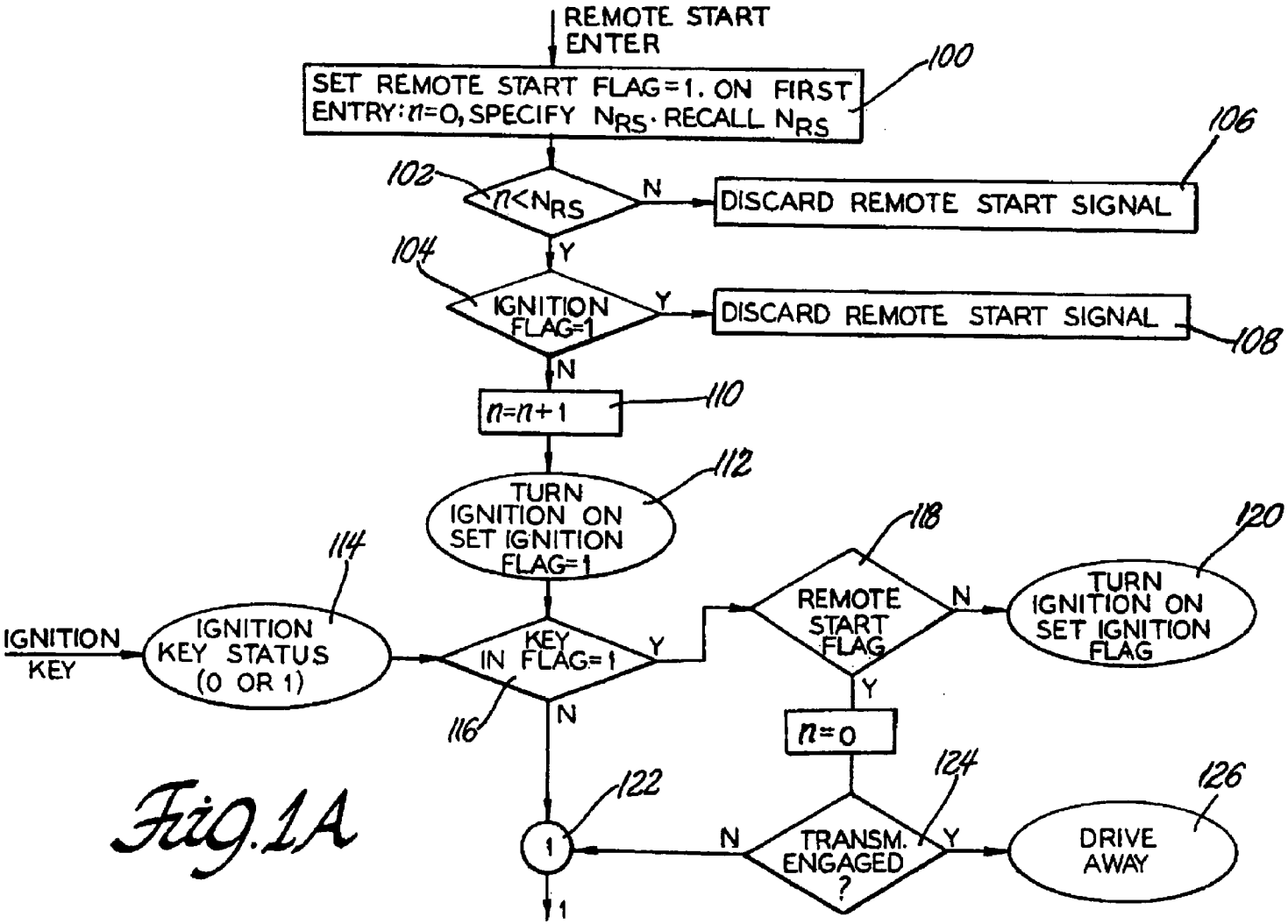

Busy vehicle operators may wish to start their vehicle from a remote location to warm the engine and adjust the temperature of the passenger compartment. In conditions where the parked vehicle is too cold or hot for passenger comfort, the climate of the passenger compartment can be brought to a comfortable level while the operator is performing other tasks. When the passenger compartment is comfortable, the operator enters the vehicle and drives away.

The initiation of the engine start-up practice of this invention can occur in different ways. In one mode, the driver simply reaches into the vehicle, places the key in the ignition, starts the engine and then closes the door and leaves the vehicle for a period of a few minutes or so while the passenger compartment is warmed or cooled. In a second mode of operation, the operator has a hand-held, remote start device that is used to start the engine without an ignition key. The operator may send the start signal from inside the business or residence to a vehicle that is in the garage or parked on the driveway. In a third remote start practice, the operator requests a satellite based communication system such as OnStar™ to transmit the engine start signal. An OnStar™ signal can be sent at a prearranged time allowing a vehicle owner to arrive at the vehicle within a few minutes of start-up. In each of the last two start-up modes, the driver is not present following engine start and the vehicle can be operated under control of an engine control module or a powertrain control module (PCM). In accordance with this invention, a suitable programmed micro-controller takes over control of engine fuelling and operation of the electric load devices that affect the environment of the passenger compartment.

If the electronic control system of the vehicle is programmed to recognize that the driver does not intend to drive the vehicle immediately after the engine is started, engine operation and electrical load devices used during vehicle operation can be managed differently than for a quick start and drive away. The operation of the vehicle with no operator present can be simplified by reducing the electrical load devices affecting the passenger compartment. The engine can be operated for better fuel economy and lower exhaust emissions during the start up of an unoccupied vehicle. In general, the engine can be operated under leaner fuel injection so long as the engine does not have to power other devices such as passenger compartment fans, air conditioners, window defroster and defogger and the like. Leaner fuel operation can reduce cold start exhaust emissions.

Thus, the practice of the subject invention contemplates the expanded use of items that are typically present on a modern automotive vehicle. The method of the invention is suitably executed through the digital processing and commands of a PCM. The PCM will receive data from sensors which continually monitor the temperature of the engine coolant, the ambient air inducted into the cylinders of the engine and the passenger compartment. In other words, the method is applicable to a modern internal combustion engine having several cylinders, typically 3 or more, into which air is inducted in response to the opening of a throttle, and into which fuel is injected by fuel injectors. The time of injection is controlled by the PCM using input from crank shaft position sensors and other sensor inputs. It is also contemplated that the exhaust system of the vehicle through which engine exhaust gases are passed will include a catalytic converter and suitable sensor of the oxygen content of the exhaust gas or other sensor that suitably monitors exhaust gas composition. Both the catalytic converter and the exhaust gas composition sensor typically have to be heated, either supplementaly or by hot engine exhaust gases, to an operating temperature at which the catalyst is active and the sensing element in the exhaust gas sensor is activated.

Apart from the engine operating sensors and exhaust control devices, the modern vehicle also has several electric load devices such as a passenger compartment air circulation fan, an air conditioner to cool air blown into the passenger compartment, internal lights including instrument panel lights, a rear window defogger and a mechanism for blowing warm air on the front windows for defrosting. Other electrical load devices may also be found in the passenger compartment such as seat heaters. The operation of these devices consume power, which ultimately is supplied by the engine, and they affect engine operation particularly in the first several seconds to a few minutes of engine operation.

The following is a description of a method of managing engine start-up with a view to reducing fuel consumption and reducing the content of carbon monoxide, unburned hydrocarbons and nitrogen oxides in the exhaust of a gasoline fueled or diesel fueled internal combustion engine. As stated the practice of the invention largely is executed by an engine control module or powertrain control module that includes a microprocessor unit including a database that will execute controls for the various functions of the engine and the operation of the passenger compartment accessories. A method for monitoring such a start-up will now be described with reference to FIGS. 1A–1D of the drawings.

The powertrain control module commences the process by setting certain values in its random access memory to zero. For instance, the ignition key-in flag is set to zero as well as the ignition flag and the flag counting remote start commands.

Upon receipt of a remote start command, the process executed in the powertrain control module begins, at process block 100 of FIG. 1A. Upon the receipt of the first such remote start command the value of n (number of current remote start commands) is set to zero. A maximum number of allowable remote start requests, $N_{RS}$, is pre-specified in the RAM. When a remote start command is received, the value of $N_{RS}$ is recalled. A value of $N_{RS}$ is specified to stop the process if a series of remote start commands beyond the specified maximum allowable is received by the engine.

The process then proceeds to query block 102. In query block 102 the powertrain control module determines whether or not the number of remote start requests is less than the specified limit, $N_{RS}$. If the value of n is less than the limit, the process proceeds to query block 104 to determine whether the ignition has already been started. If in query block 102 the number of remote start signals has exceeded $N_{RS}$ the incoming remote start signal is ignored per decision block 106.

If in query block 104 the ignition is already on (ignition flag=1), then the powertrain controller discards the remote start signal as superfluous per decision block 108. But if the ignition is not already on, and the number of the remote start requests have not exceeded the maximum, the powertrain control module updates the remote start counter to n+1, block 110, and proceeds to start the engine.

The "ignition on" command is issued in oval command block 112 and the PCM sets the ignition flag 1 (or ON). The PCM then determines in query block 116 whether there is an ignition key in the ignition on the steering column. It is recalled that the ignition key flag was initially set to zero, but an ignition key may have been inserted during subsequent microprocessor cycles.

If there is no key in the ignition, query block 116, the PCM concludes that a bone fide remote start command has been received and the process proceeds to block 122 for entry into such process.

But if a key is in the ignition, block 114, the ignition key flag is set to one in the PCM memory. This indicates that the driver is in the vehicle following a remote start process. If the ignition key signal is identified in query block 116, the powertrain control module then looks, in query block 118, to see if a remote start command has been received. If a remote start command has not been received (no in query box 118) entry into the subject remote start process is not appropriate. Since the key is in the ignition, the situation calls for a normal start and a "start" command is issued, block 120. However, if the PCM has received a remote start command (yes in query block 118), and the key is in the ignition, the PCM resets the remote start counter to zero, block 128, and looks to see if the transmission is engaged, query block 124.

If the query in block 124 is answered "yes" the vehicle is being driven, command block 126 (i.e., a normal drive away is executed) and no remote start processing is started or continued. But if the transmission is not engaged, the process advances to block 122 from which entry is made into a remote start process of this invention.

Thus the process loop of FIG. 1A through blocks 100 to 126 is executed every 100 to 200 milliseconds to determine whether the remote start process is to be started or continued.

Figure 1B:
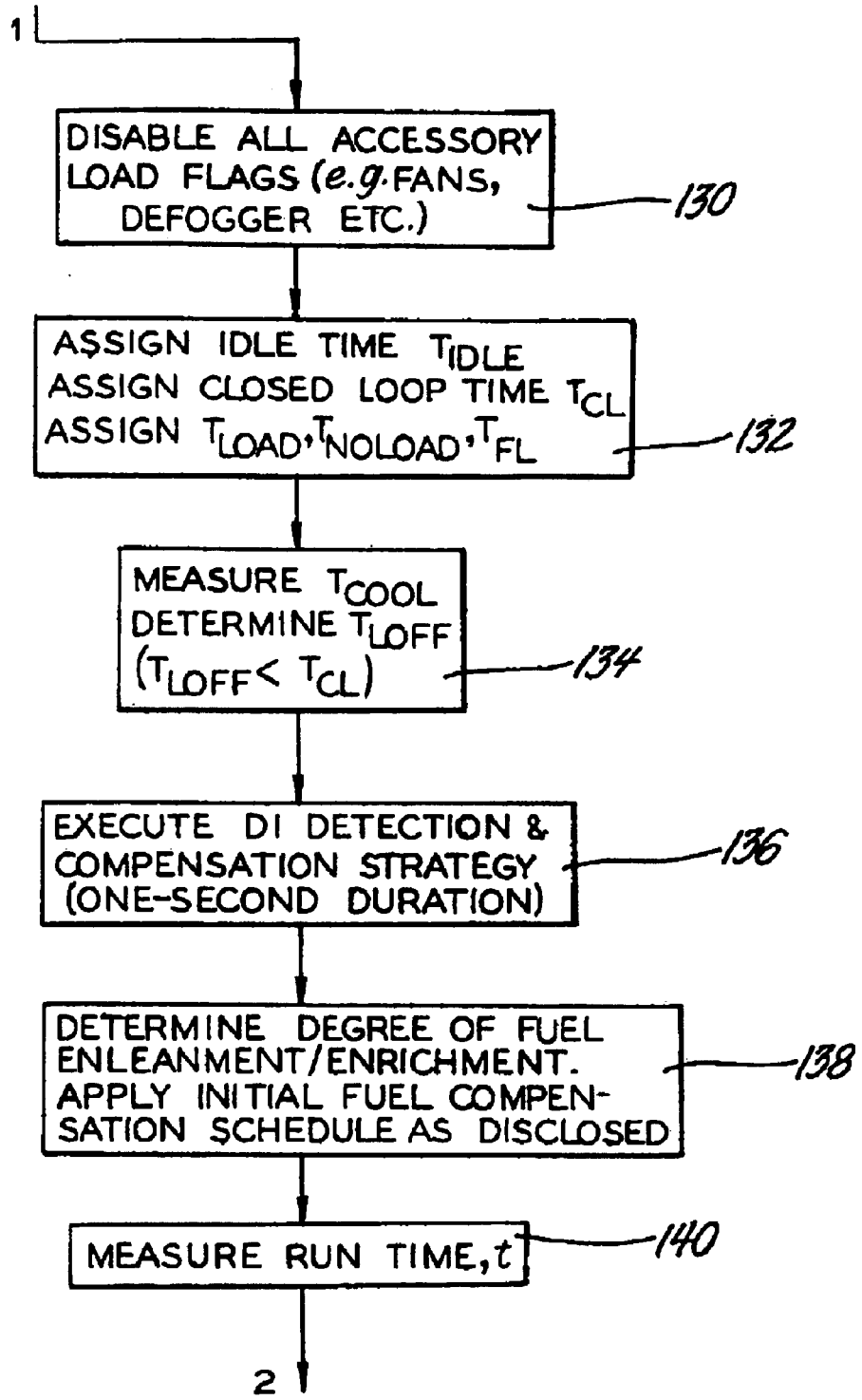

After the ignition is turned on, and the ignition flag set to one, block 122, the process proceeds to block 130 at the top of FIG. 1B. With the engine now running, the powertrian control module shuts down all passenger compartment electrical load devices (block 130), such as air circulation fans, the air conditioner, window defogger, window defroster, seat heaters, lights and the like. This is accomplished by disabling the accessory load flags in the memory of the powertrian control module. This command assures that the unoccupied passenger compartment is not presently adding to the power requirements of the just started vehicle engine.

The PCM then assigns certain operating time periods for management of this remote start process. Referring to block 132, the PCM sets an idle time ($T_{IDLE}$) for all following process steps. Ten minutes is often a suitable period for $T_{IDLE}$. This idle time is the total and maximum period during which idle engine operation is to be permitted by the powertrain control module during a remote start process cycle.

The powertrain control module also estimates a time period, $T_{CL}$, by which closed loop PCM control of fuel injection to the engine can be initiated because the exhaust system has reached its operating temperature. In block 132 the PCM also assigns a $T_{LOAD}$, which is the time period, preferably following the achievement of closed loop PCM engine control, in which all passenger compartment accessories are sequentially brought into operation. The PCM also assumes a full load time period, $T_{FL}$, during which all the passenger compartment electrical loads are operated at engine idle pending the arrival of the driver. The PCM finally estimates a no-load time, $T_{NOLOAD}$, which is a time period for sequentially shutting down the electrical loads pending the arrival of the operator. For example, the PCM may set a maximum idle time, $T_{IDLE}$, of 10 minutes. It may estimate a closed loop operability, $T_{CL}$ of 30 to 60 seconds, which would be the time required for the engine exhaust to heat the catalytic converter and the oxygen sensor to their respective operating temperatures. The PCM may assign an accessory load turn on time of 1 minute. It may assign a time for the full loading of operation of the accessories of 3 minutes and a time for shutting down the respective accessory loads of another 1 minute. These values may be predetermined by the engine manufacturer and stored in the PCM memory. Alternatively, they may be calculated based on current sensor detected values of engine coolant temperature and/or ambient air temperature.

The process moves to box 134, in which the current engine coolant temperature, $T_{COOL}$, is measured by a sensor supplying this data to the PCM. The processor estimates a time for light-off of the catalytic converter, $T_{LOFF}$. $T_{LOFF}$ is the time that the catalytic converter is estimated to be operating at about fifty percent of its normal efficiency in catalyzing the oxidation of unburned hydrocarbons and carbon monoxide. If desired, some enrichment of the air to fuel ratio could be commanded since some catalyst activity is available. However, at $T_{LOFF}$ neither the catalytic converter nor the exhaust sensor are fully operational and closed loop fuel control cannot be used. Thus, the value of $T_{LOFF}$ will be less than $T_{CL}$. During subsequent control module operation, the engine run time is monitored, block 140, as a basis for execution of timely PCM commands as will be described.

The process moves to block 136. At this stage of the process, the computer executes detection of the volatility or drivability index (DI) of the fuel actually being injected into the engine cylinders. This process is carried out, for example, in accordance with the speed decrease (or droop) determination following engine starting as described in the '726 patent. Thus, having determined speed decrease after engine starting within a period of one second or so of engine operation, the PCM checks its memory database for a more suitable, i.e., leaner air to fuel ratio and reduces the duration of fuel injector duty time accordingly. Following this step in box 136, the engine will operate leaner and it can do so in part because of the fact that the accessories that are providing services to the passenger compartment have been shut down in block 130. The process then moves to block 138, in which the block 136 correction in fuel enleanment or enrichment is applied as an initial fuel injection schedule. The newly determined fuel injection rate, $M_f(t)$, will be used during the PCM open loop control portion of this process.

Engine run time is continually tracked as indicated in process block 140. The process proceeds to FIG. 1C.

The engine is now being operated at a fuel enleaned (or enriched, if the determined volatility is low) condition based on a determination of the volatility of the vehicle's fuel. The PCM uses this data to specify fuel injector duty time, block 142, as the engine warms during the first seconds of its running (idle) time. The PCM continues to track and increment total engine run time, block 144. The PCM control loops are of a period of 12.5 milliseconds following engine start. The process is now in a first control loop between process boxes 142, 144, 146 until catalyst light off time, $T_{LOFF}$, is reached. In box 146, the current run time, t, is compared with the estimated time for catalyst light off, $T_{LOFF}$ until that time has elapsed.

Once the catalytic converter light off period has elapsed, the process enters a new loop between process boxes 148, 150 and 152 until the time for closed-loop PCM control is reached. During this engine idling period between catalyst light off and full catalyst activity for closed loop PCM engine control there is an opportunity in the process for further fuel ratio adjustment. Preferably, however, the PCM maintains the same fueling level that it had estimated until such time that the total operating time reaches the estimated time for closed loop operation. Process box 148 maintains the fuelling level, $M_f$, while comparing the engine running time with the estimated time for closed loop control, box 150, and incrementing the running time, box 152, until $T_{CL}$ is reached.

Once sufficient time has elapsed for close loop operation, the PCM commences using exhaust sensor signals in determining fuel injector duty time in accordance with current engine control practices. The subject engine remote start process also proceeds from box 150 to box 154.

Figure 2:
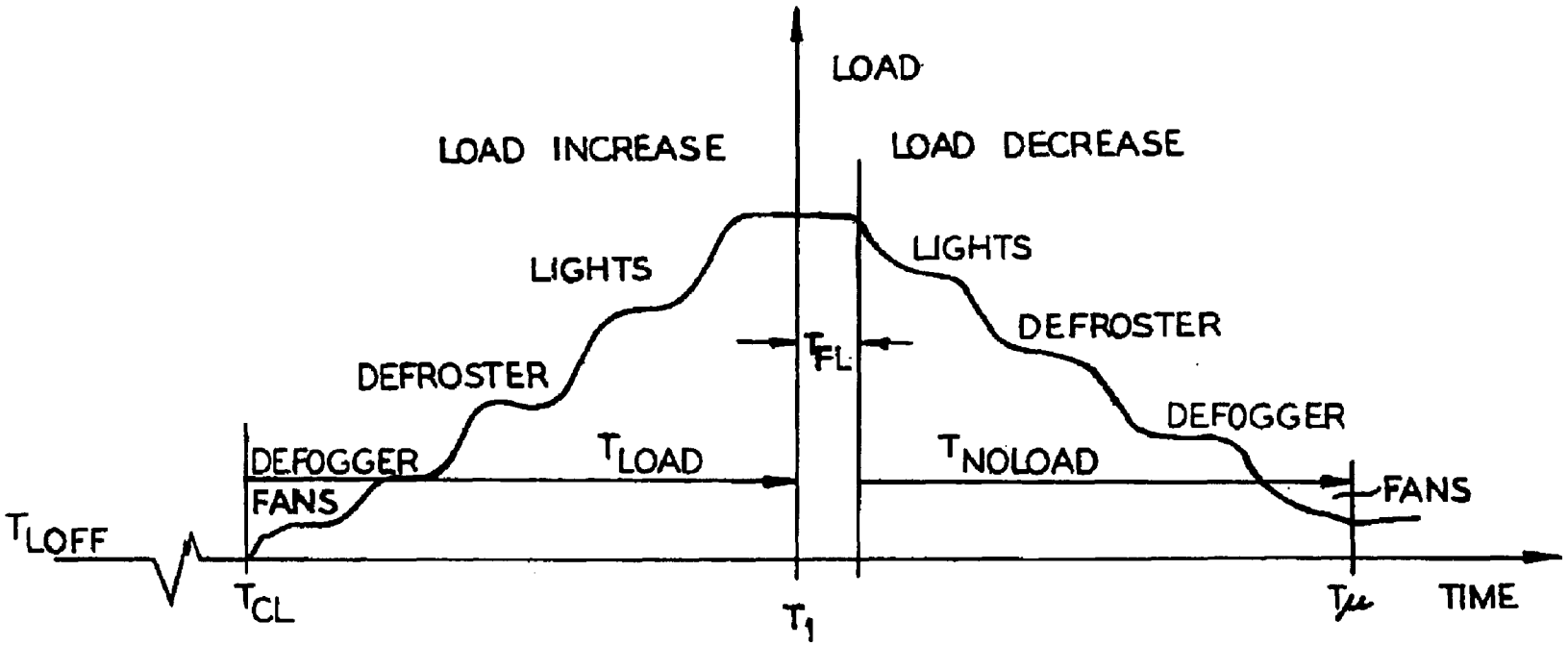
FIG. 2 is a graph illustrating schematically the application and removal of electrical loads in accordance with an embodiment of the invention during the time following a remote engine start.

In box 154, the PCM commences activating the passenger compartment accessories in a predetermined sequence. The sequence can also be illustrated by reference to FIG. 2. FIG. 2 is a graph of time, x-axis, vs. the electrical load of passenger compartment accessories, y-axis. Viewed form the left side of FIG. 2, it is seen that following $T_{LOFF}$ and arrival at $T_{CL}$ the respective electrical loads are sequentially applied in a sequence predetermined for adjustment of passenger compartment climate and efficient engine operation. Following is an example of a sequence involving heating of the passenger compartment and clearing of the vehicle windows. In this example, it is assumed hot engine coolant is now flowing through the vehicle's heater and that vehicle's temperature control system is set to direct fan blown air through the heat exchanger and into the passenger compartment.

Figure 1C:
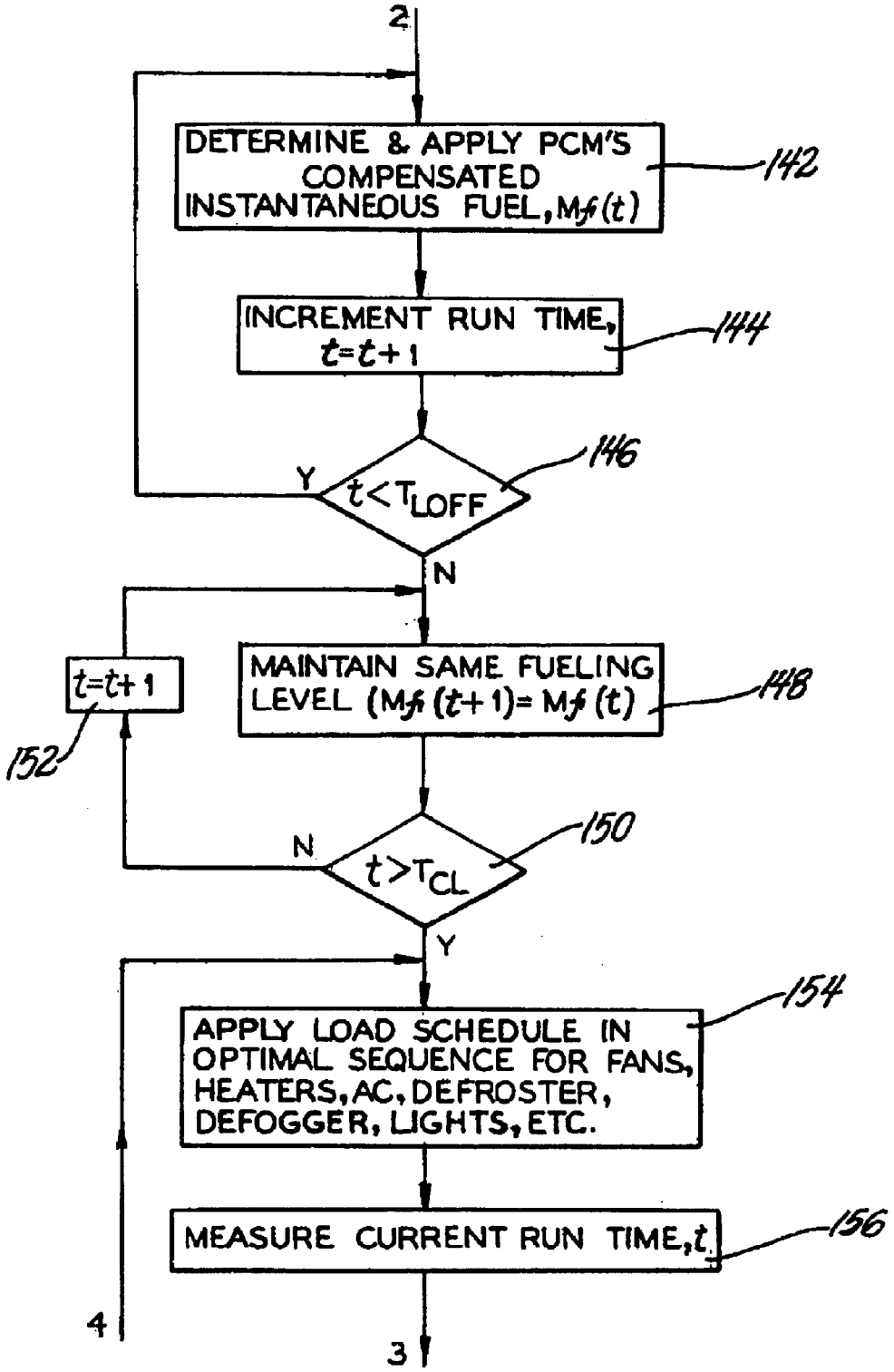
Figure 10:
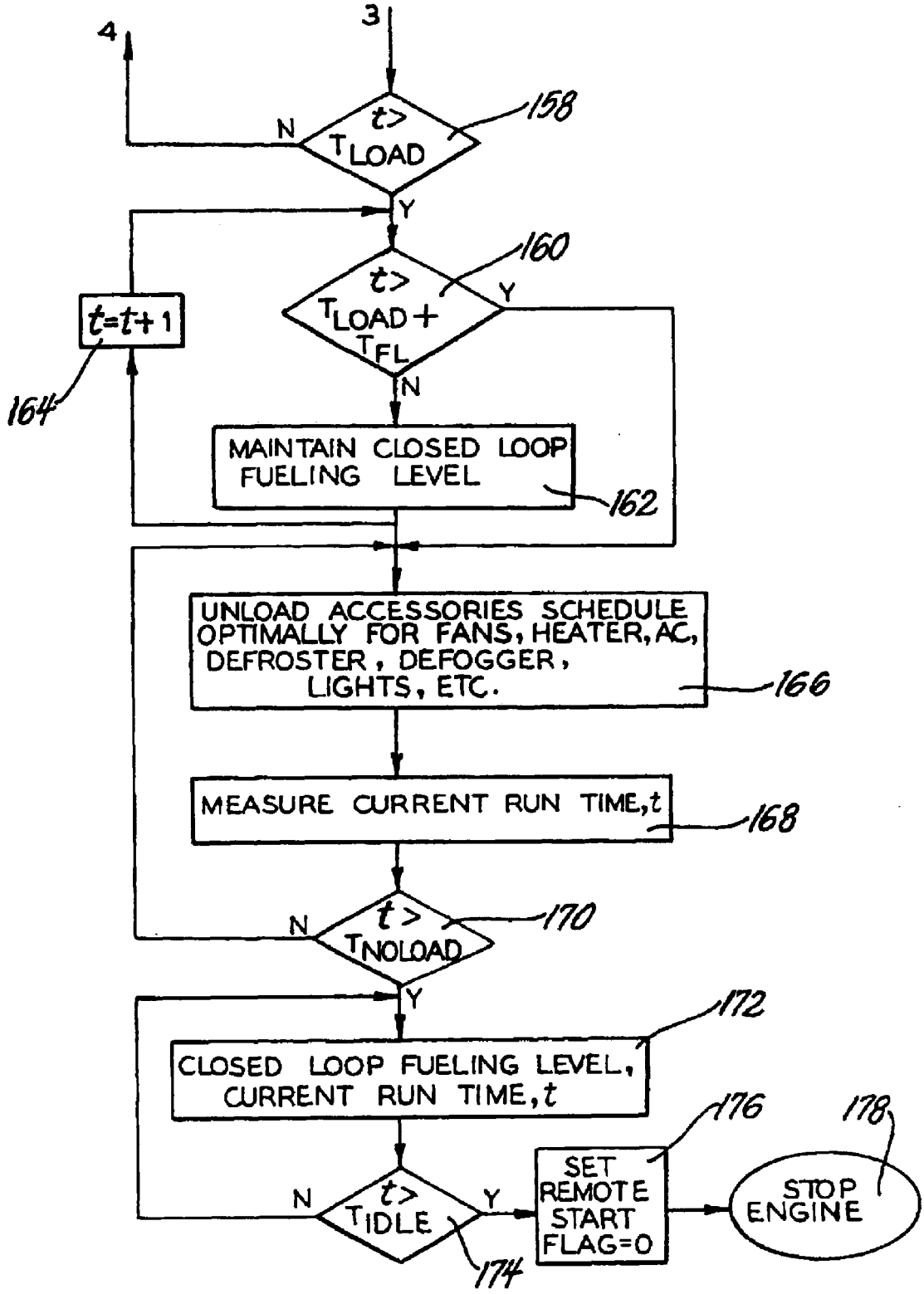

Referring to process box 154, FIG. 1C and to FIG. 2 it is seen that upon reaching closed loop engine operation time, $T_{CL}$, the passenger compartment fan is turned on followed by the defogger, the defroster and then by the instrument panel lights (and any other specified device such as a seat heater, radio or the like). As illustrated in FIG. 2, each electrical load in the sequence is operated for several seconds before the next load is turned on by command of the PCM. This gradual addition of passenger compartment load devices may be accomplished over a period, $T_{LOAD}$, of 1 minute or so during the loading loop boxes 154, 156 (measurement of current time) and 158 (time for the application of electrical load devices, $T_{LOAD}$) at the top of FIG. 1D.

Following execution of the load schedule in the process loop through boxes 154, 156 and 158, the process awaits the arrival of the vehicle operator and movement of the vehicle. However, unless interrupted by the placement of a key in the ignition, box 114 and/or the engagement of the transmission, box 124, the PCM continues to monitor elapsed time from engine start, box 160. After the $T_{LOAD}$ period has elapsed, marked by $T_1$ in FIG. 2, all of the specified passenger compartment accessories have been turned on and are operating to heat the compartment and clear the windows.

Under the specified full passenger compartment electrical load, the process loops between boxes 160, 162 and 164 which is a new cycling sequence. In inquiry box 160 the elapsed time, t, is compared with the sum of the load application time, $T_{LOAD}$ and the permitted engine idle time at full load, $T_{FL}$. During this time period, fuel injection is based on closed loop PCM control, box 162 and the time is incremented, t=t+1, box 164. Full load accessory operation is also illustrated in FIG. 2, during the $T_{FL}$ period. At the end of this full load operation the passenger compartment has been heated, or cooled, as specified by the driver setting of the electronic temperature control system. If the process is not interrupted by driver activity, the process leaves the full electrical device loading and enters a new process control loop in which the devices are gradually shut off. Since it is not known when the operator will arrive, the process acts to reduce the load on the idling engine.

After $T_{FL}$ has been exceeded, the process proceeds to the process loop of boxes 166, 168 and 170. Commands from box 166 sequentially shut down the electrical devices, preferably in the reverse order in which they were activated. Referring to FIG. 2, it is seen in this example that the load devices are shut down in the reverse order in which they were activated. Thus, in box 166 the lights would be shut off first, then the defroster, then the defogger and finally the fan, all within the time allotted for unloading or no loading of accessories $T_{NOLOAD}$. This is accomplished in the PCM by continuing to measure current run time, t, in box 168 and comparing the run time with the devices unloading time, $T_{NOLOAD}$, in box 170.

Once the time, t, has exceeded the time scheduled for unloading in box 170, the process continues to box 172 in which closed loop management of fuel injection is continued pending the lapse of the total permitted idle time, $T_{IDLE}$, box 174. Once the current run time exceeds the total permitted idle time, query box 174, the engine is stopped, box 178 ($T_u$ in FIG. 2), and the remote start flag is set to zero, box 176. This completes the entire process in which the engine was started and operated under different fuel control regimes. Passenger compartment accessories were started, operated and shut down all without operator intervention following a remote start signal.

Of course at any time in the process, if the PCM detects the presence of a key in the ignition or the engagement of the transmission, the vehicle is simply driven away then under open loop or closed loop control as the actually operating time may have indicated. As soon as the transmission is engaged the process of this invention is discontinued in favor of the normal driver actuated vehicle movement.

Thus, it is seen that the process of this invention enables a driverless start-up of a vehicle engine. In one embodiment an electronic signal from a remote source is received by a sensor in the vehicle and the starter motor and ignition system are activated for engine start. In another embodiment the operator uses the ignition key for engine start and leaves the vehicle temporarily during engine "warm-up." The PCM then manages engine operation and passenger compartment electrical loads.

The amount of fuel injected into the engine is set based on detection of the driveablity index of the fuel in accordance with the '726 patent. At the same time, the accessories that manage the passenger compartment climate are turned off and not used until after a minute or so of engine operation when the engine has reached a closed loop mode of operation with the catalytic converter and exhaust stream fully activated. Then, for over a limited period of time, the passenger compartment electrical devices are turned on all awaiting the arrival of the driver. If the driver does not arrive after a set time, the operating devices are shut off and finally, if the driver has not arrived, the engine is shut down all together.

Thus, the invention has been described in terms of a preferred embodiment. It will be appreciated other modes of the invention could readily be adapted by those skilled in the art. Accordingly, it is to be understood that the invention is to be limited only by the following claims.

What is claimed is:

1. A method of managing operation of a passenger vehicle engine and passenger compartment electrical devices upon engine start-up when the vehicle operator is not ready to drive the vehicle, said method using an in-vehicle electronic control module including a micro-processor and database; said vehicle comprising at least one fuel injector for injecting fuel into combustion cylinders of said engine and exhaust gas system comprising an underfloor catalytic converter and an exhaust gas composition sensor; said passenger compartment electrical load devices comprising, at least some of, a fan for circulation of passenger compartment air, a rear window defogger, a front window defroster, an air conditioner for cooling passenger compartment air, a seat heater, and passenger compartment lights; said method comprising monitoring time, t, from engine start, a providing the engine has been started from a remote signal or the vehicle transmission ha not been engaged;

turning off passenger compartment electrical loads;

continually measuring engine coolant temperature and engine intake air temperature;

estimating the time elapsed, $T_{CL}$, before aid catalytic converter and exhaust gas sensor are suitably active for closed loop fuel control by said control module;

determining the priorities of operation of the respective said electric load devices; and turning on said devices sequentially in order of said determined increasing priority after $t>T_{CL}$.

2. A method as recited in claim 1 comprising measuring engine rpm immediately following engine start and estimating the amount of fuel to be injected into the cylinders of said engine based on a decrease in said engine speed following engine start, and injecting said amount of fuel into combustion cylinders of said engine during a period until $T_{CL}$.

3. A method as recited in claim 1 comprising turning said engine off after said devices have been turned on if said operator does not drive said vehicle within a specified time period following engine start.

4. A method as recited in claim 1 comprising estimating time periods following engine start for the sequential turning on of said devices, $T_{LOAD}$; for the operation of each of said devices during engine idle, $T_{FL}$; and for sequentially turning off said devices during engine idle, $T_{NOLOAD}$.

5. A method as recited in claim 4 comprising turning on said devices during said $T_{LOAD}$ period; and, until a vehicle drive starts driving said vehicle; operating said devices during said $T_{FL}$ period, and thereafter sequentially turning off said devices during said $T_{NOLOAD}$ period.

6. A method as recited in claim 5 comprising shutting off said engine following said $T_{NOLOAD}$ period if said driver has not started driving said vehicle.

7. A method of starting a passenger vehicle engine and passenger compartment electrical devices upon operator command when the vehicle operator is not ready to drive the vehicle, said method using an in vehicle electronic control module including a micro-processor and database; said vehicle comprising at least one fuel injector for injecting fuel into combustion cylinders of said engine and a exhaust gas system comprising an underfloor catalytic converter and an exhaust gas composition sensor; said vehicle further comprising means for measuring engine speed; said passenger compartment electrical load devices comprising, at least some of, a fan for circulation of passenger compartment air, a rear window defogger, a front window defroster, an air conditioner for cooling passenger compartment air, a seat heater, and passenger compartment lights; said method comprising starting said engine using a predetermined first rate of injection of fuel in to said cylinders;

monitoring time, t, from engine start, and providing the engine has been started from a remote signal or the vehicle transmission has not been engaged;

turning off passenger compartment electrical loads;

measuring engine speed immediately following engine start to detect a drop in speed and using the magnitude of said drop in speed to estimate a second rate of fuel injection into said cylinders;

continually measuring engine coolant temperature and engine intake air temperature;

estimating the time elapsed, $T_{CL}$, before said catalytic converter and exhaust gas sensor are suitably active for closed loop fuel control by said control module;

injecting said second amount of fuel into said cylinders during a period until $T_{CL}$;

determining the priorities of operation o the respective said electric load devices; and turning on said devices sequentially in order of said determined increasing priority after $t>T_{CL}$.

8. A method as recited in claim 7 practiced when said engine has been started in response to an electronic signal transmitted to said vehicle from a source remote from said vehicle.

9. A method as recited in claim 7 comprising turning said engine off after said devices have been turned on if said operator does not drive said vehicle within a specified time period following engine start.

10. A method as recited in claim 9 practiced when said engine has been started in response to an electronic signal transmitted to said vehicle from a source remote from said vehicle.

11. A method as recited in claim 7 comprising estimating time periods following engine start for the sequential turning on of said devices, $T_{LOAD}$; for the operation of each of said devices during engine idle, $T_{FL}$; and for sequentially turning off said devices during engine idle, $T_{NOLOAD}$.

12. A method as recited in claim 11 comprising turning on said devices during said $T_{LOAD}$ period; and, until a vehicle driver starts driving said vehicle; operating said devices during said $T_{FL}$ period, and thereafter sequentially turning off said devices during said $T_{NOLOAD}$ period.

13. A method as recited in claim 12 comprising shutting off said engine following said $T_{NOLOAD}$ period if said driver has not started driving said vehicle.

14. A method as recited in claim 13 practiced when said engine has been started in response to an electronic signal transmitted to said vehicle from a source remote from said vehicle.

15. A method as recited in claim 12 practiced when said engine has been started in response to an electronic signal transmitted to said vehicle from a source remote from said vehicle.

16. A method as recited in claim 11 practiced when said engine has been started in response to an electronic signal transmitted to said vehicle from a source remote from said vehicle.

* * * * *